US007651347B2

(12) United States Patent
Germain et al.

(10) Patent No.: US 7,651,347 B2
(45) Date of Patent: Jan. 26, 2010

(54) TAMPER RESISTANT MECHANISM WITH CIRCUIT INTERRUPTER

(75) Inventors: Frantz Germain, Rosedale, NY (US); Roger M. Bradley, North Bellmore, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 627 days.

(21) Appl. No.: 11/554,445

(22) Filed: Oct. 30, 2006

(65) Prior Publication Data

US 2007/0111569 A1 May 17, 2007

Related U.S. Application Data

(60) Provisional application No. 60/732,327, filed on Oct. 31, 2005.

(51) Int. Cl.
*H01R 13/44* (2006.01)

(52) U.S. Cl. ..... 439/137

(58) Field of Classification Search ..... 439/135–141, 439/188, 911; 361/42
See application file for complete search history.

(56) References Cited

U.S. PATENT DOCUMENTS

| | | | |
|---|---|---|---|
| 2,540,496 | A | 2/1951 | Sperazza |
| 2,826,652 | A | 3/1958 | Piplack |
| 2,926,327 | A | 2/1960 | Metelli |
| 3,222,631 | A | 12/1965 | Cohen |
| 3,238,492 | A | 3/1966 | Houston |
| 3,617,662 | A | 11/1971 | Miller |
| 3,775,726 | A | 11/1973 | Gress |
| 3,986,763 | A | 10/1976 | Sparrow |
| 3,990,758 | A | 11/1976 | Petterson |
| 4,072,382 | A | 2/1978 | Reschke |
| 4,148,536 | A | 4/1979 | Petropoulsos et al. |
| 4,168,104 | A | 9/1979 | Bushow |
| 4,271,337 | A | 6/1981 | Barkas |

(Continued)

FOREIGN PATENT DOCUMENTS

| | | |
|---|---|---|
| GB | 2 396 489 A | 6/2004 |
| WO | WO 00/17728 A2 | 3/2000 |

OTHER PUBLICATIONS

PCT International Search Report and Written Opinion for PCT/US06/60378 dated Oct. 1, 2007.

*Primary Examiner*—Neil Abrams
(74) *Attorney, Agent, or Firm*—Carter, DeLuca, Farrell & Schmidt, LLP

(57) ABSTRACT

A tamper-proof receptacle is provided wherein the receptacle comprises sliding shutters disposed between phase and neutral terminals of the receptacle and openings in the face of the receptacle. The shutters are connected to circuit interrupting circuitry such that when one of the shutters is displaced through a specific range of motion, the circuit interrupting portion of the receptacle is triggered to disconnect electrical power from the phase and neutral terminals of the receptacle. In an embodiment, a logic circuit is connected to the shutters, and a monitoring circuit monitors supply of power to the face terminals. The logic circuit is configured to detect insertion of an object into only one of the pair of openings. A signal from the logic circuit to the circuit interrupting device is effective to prevent the object from touching any of the face terminals while power is connected to the face terminals.

20 Claims, 4 Drawing Sheets

U.S. PATENT DOCUMENTS 4,379,607 A 4/1983 Bowden, Jr.
4,544,219 A 10/1985 Barkas
4,603,932 A 8/1986 Heverly
4,714,858 A 12/1987 Sanders
4,722,693 A 2/1988 Rose
4,867,693 A 9/1989 Gizienski et al.
4,867,694 A 9/1989 Short
4,897,049 A 1/1990 Miller et al.
4,909,749 A 3/1990 Long
4,936,789 A 6/1990 Ugalde
5,006,075 A 4/1991 Bowden, Jr.
5,020,997 A 6/1991 Calderara et al.
5,069,630 A 12/1991 Tseng et al.
5,277,607 A 1/1994 Thumma et al.
5,320,545 A 6/1994 Brothers
5,374,199 A 12/1994 Chung
5,391,085 A 2/1995 Tigner
5,518,132 A 5/1996 Chen
5,551,884 A 9/1996 Burkhart, Sr.
5,702,259 A 12/1997 Lee
5,839,909 A 11/1998 Calderara et al.
5,846,092 A 12/1998 Feldman et al.
5,902,140 A 5/1999 Cheung et al.
5,915,981 A 6/1999 Mehta
6,086,391 A 7/2000 Chiu
6,111,210 A 8/2000 Allison
6,149,446 A 11/2000 Yu
6,217,353 B1 4/2001 Yu-Tse
6,224,401 B1 5/2001 Yu
6,238,224 B1 5/2001 Shao
6,299,487 B1 10/2001 Lopata et al.
6,422,880 B1 7/2002 Chiu
6,537,088 B2 3/2003 Huang
6,537,089 B1 3/2003 Montague
6,734,769 B1 5/2004 Germain et al.
6,749,449 B2 6/2004 Mortun et al.
6,767,228 B2 7/2004 Katz
6,776,630 B1 8/2004 Huang
6,786,745 B1 9/2004 Huang
6,873,231 B2 3/2005 Germain et al.
6,893,275 B2 5/2005 Ng et al.
6,949,994 B2 9/2005 Germain et al.
6,963,260 B2 11/2005 Germain et al.
6,969,801 B2 11/2005 Radosavljevic et al.
6,979,212 B1 12/2005 Gorman
6,986,674 B1 1/2006 Gorman
7,026,895 B2 * 4/2006 Germain et al. ..... 335/18
7,088,205 B2 8/2006 Germain et al.
7,088,206 B2 8/2006 Germain et al.
7,114,968 B2 10/2006 Healy
7,179,992 B1 * 2/2007 Packard et al. ..... 174/53
7,227,435 B2 6/2007 Germain
7,312,963 B1 * 12/2007 Radosavljevic et al. ..... 361/42
7,355,117 B2 4/2008 Castaldo et al.
7,455,538 B2 * 11/2008 Germain ..... 439/137
2002/0097546 A1 7/2002 Wienberger
2004/0203270 A1 10/2004 Wang
2005/0039938 A1 2/2005 Radosavljevic et al.
2007/0049077 A1 3/2007 Germain et al.
2007/0049079 A1 3/2007 Nalwad et al.
2007/0111569 A1 5/2007 Germain et al.
2007/0211397 A1 9/2007 Sokolow et al.

* cited by examiner

TAMPER RESISTANT MECHANISM WITH CIRCUIT INTERRUPTER

CROSS-REFERENCE TO RELATED APPLICATION

This application claims priority pursuant to 35 U.S.C. 119 (e) from U.S. Provisional Application having Application No. 60/732,327 filed Oct. 31, 2005.

FIELD OF THE INVENTION

The present invention relates to a tamper-proof receptacle for supplying electrical current to a load.

BACKGROUND OF THE INVENTION

The present invention relates to electrical receptacles of the type having slidable shutter mechanisms arranged behind the receptacle openings that receive the blades or prongs of an electrical plug connected to the receptacle.

In order to prevent electrical shocks and possible injuries which may result from insertion of an electrically conducting member into the live terminals of an electrical receptacle, electrical receptacles with shutter mechanisms have been developed to provide an additional level of safety to users.

These mechanisms typically include a plurality of moveable members that are spring-biased to positions wherein the moveable member masks the plug-receiving openings thereby shielding the live terminals within the receptacle. The shutter members are moved laterally by objects inserted through the openings in the receptacle cover. However, the structure is such that the shutter members must be moved in unison, such as when plug blades are inserted in the receptacle openings, in order to achieve physical access to and electrical communication with the terminals. That is, when a single shutter member is moved independently by insertion of a device through a single opening, the other shutter member remains stationary with a portion in a blocking position to prevent advance of the device into contact with the receptacle terminals. Such an arrangement does not, however prevent tampering with the receptacle such as when an object is inserted through a single opening and contacts an energized contact within the receptacle.

There is a need, therefore, for an improved shutter mechanism to address tampering of an energized receptacle or the inadvertent insertion of an object into one of its openings.

SUMMARY OF THE INVENTION

It is the object of the present invention to provide an electrical receptacle having a novel and improved safety shutter mechanism to overcome a number of deficiencies of prior art mechanisms of this type. The present invention is directed to a tamper-proof receptacle having a circuit-interrupting device. The receptacle is configured so that the circuit-interrupting device will trip and remove power from the face terminal of the receptacle if an object is pushed into a single opening in the face of the receptacle. In contrast, if a two or three-pronged plug is inserted into the face of the receptacle, it will not trip the circuit interrupter.

According to a first aspect of the invention, a receptacle for providing power to a load includes terminals for connection to an electrical power source, and slidable shutters located between openings in the receptacle and the terminals; the shutters are operatively connected to a circuit interrupter. Displacement of one shutter causes the circuit interrupter to disconnect the terminals from the power source. In an embodiment, each of the shutters has an angled end surface so that insertion of an object through a corresponding opening causes a cam action between the object and the angled end surface, thereby causing the displacement of the shutter; a switch is operatively connected to each of the shutters, so that displacement of a shutter causes the corresponding switch to close and causes the circuit interrupter to disconnect the terminals from the power source. The inserted object therefore does not touch any of the terminals while power is connected to the terminals.

According to another aspect of the invention, a receptacle includes a face plate having a pair of openings; face terminals for connection to an electrical power source; a pair of shutters with each shutter located between an opening and a corresponding face terminal; a logic circuit connected to the shutters; a monitoring circuit, connected to the logic circuit, for monitoring supply of power to the face terminals; and a circuit interrupting device, connected to the logic circuit, for disconnecting power from the face terminals in accordance with a signal from the logic circuit. In an embodiment, the receptacle also includes a switch coupled to each of the shutters and providing an input to the logic circuit, so that displacement of a shutter causes the corresponding switch to close. The logic circuit is configured to detect insertion of an object into only one of the pair of openings. In an embodiment, the logic circuit includes an XOR gate having a pair of inputs coupled respectively to the switches, and also includes an AND gate having a first input connected to the monitoring circuit and a second input connected to the output of the XOR gate. The output of the AND gate therefore indicates insertion of an object into only one of the pair of openings while power is supplied to the face terminals.

According to a further aspect of the invention, the face plate of the receptacle has a plurality of pairs of openings and the logic circuit has a plurality of XOR gates; each of the pairs of openings has a pair of shutters with switches and face terminals corresponding thereto. Each pair of shutters is coupled to one of the XOR gates by the switches. The logic circuit further includes a plurality of AND gates and an OR gate. Each of the AND gates has a first input connected to the monitoring circuit and a second input connected to the output of one of the XOR gates. The OR gate has a plurality of inputs each connected to the output of a respective AND gate; the output of the OR gate provides the signal to the circuit interrupting device.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENTS

An embodiment of the invention comprises tamper-detection and tamper-proofing circuitry implemented in a circuit-interrupting receptacle. The device is designed to trip, and remove power from the face terminals of the receptacle, if an object is pushed into a single opening in the face. Two- and three-pronged plugs inserted into the face of the receptacle will not trip the circuit interrupter.

The following description is directed to tamper-proof circuitry implemented in a Ground Fault Circuit Interrupter (GFCI) such as described in commonly owned U.S. Pat. No. 6,040,967, the disclosure of which is incorporated herein by reference. It will be understood, however, that an embodiment of the invention may be implemented with any kind of circuit interrupting receptacle (an AFCI for example).

Figure 1:
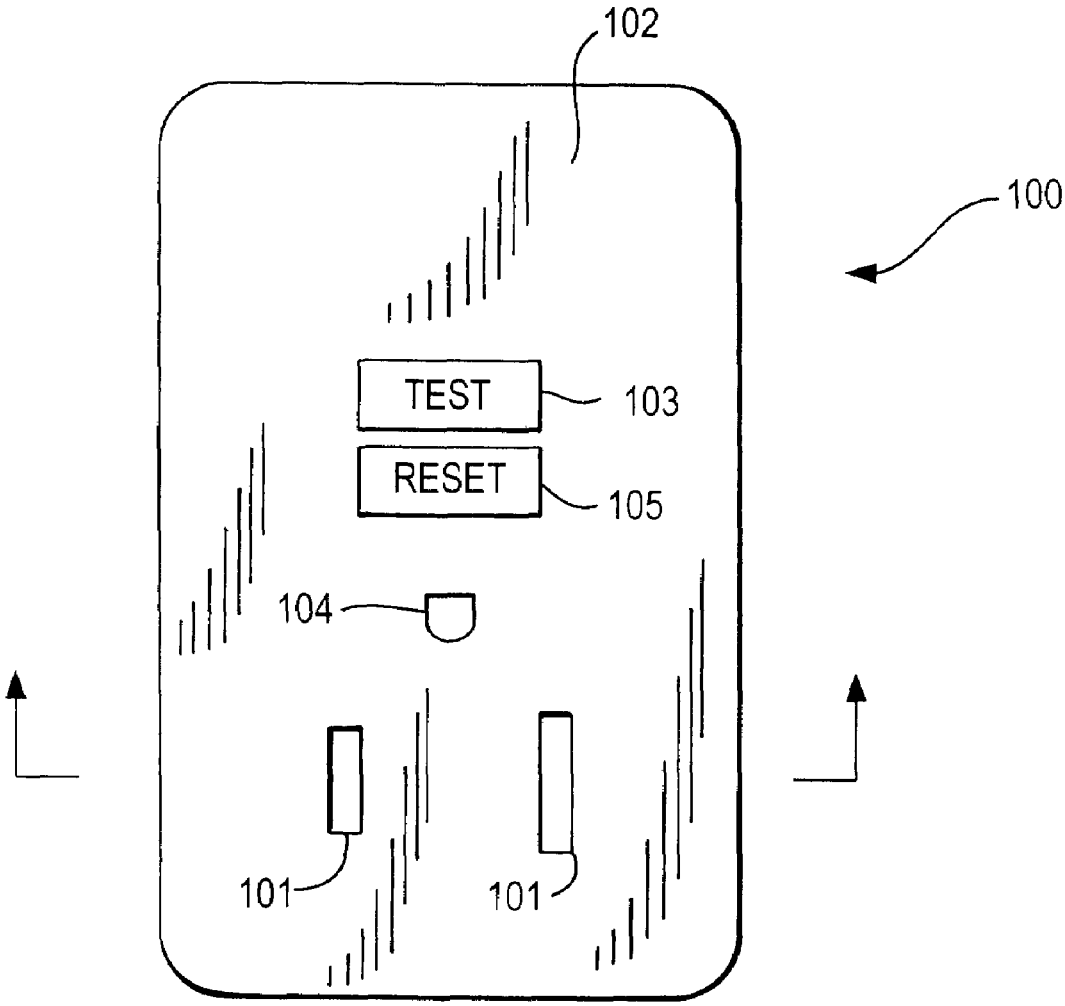
FIG. 1 depicts a receptacle according to the present invention.
Figure 2:
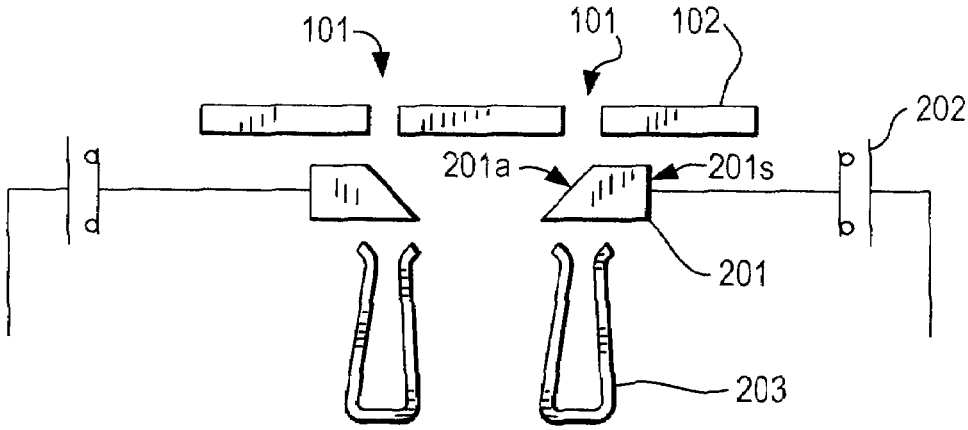
FIG. 2 depicts a detailed top sectional view of a receptacle according to the present invention with shutters closed.

Referring to FIG. 1, depicted therein is a receptacle 100 in accordance with an embodiment of the present invention. Receptacle 100 includes a faceplate 102; the faceplate has openings 101 for phase and neutral plug blades, an opening 104 for a ground prong of a plug, and TEST and RESET buttons 103, 105. Referring now to FIG. 2, depicted therein is a top sectional view of the receptacle 100 of FIG. 1. As shown in FIG. 2, the two openings 101 in receptacle 100 are each blocked by a shutter mechanism including a shutter 201. The shutters 201 are placed between openings 101 and terminals 203 and adapted to slidably open and close switches 202 when an object is inserted into one of the openings 101.

Each shutter 201 has an angled end 201*a* and a switch end 201*s*. The angled end of the shutter 201*a* completely covers the opening 101. If an object 205 is pushed into an opening 101, the angled end of the corresponding shutter is pushed sideways due to a cam action between the object and the angled end surface of the shutter (see FIG. 3). Sideways movement of the shutter 201 greater than a relatively small threshold distance (approximately 0.050") causes switch 202 to close. The shutter switch 202 remains closed throughout the range of movement of the shutters; that is, from the point where the threshold is reached to a point where the shutter 201 is completely out of the way of the opening. It should be noted that as object 205 is inserted, switch 202 is closed before the object touches terminal 203. Accordingly, power may be disconnected from terminal 203 before tampering with the receptacle can create a shock hazard.

Figure 3:
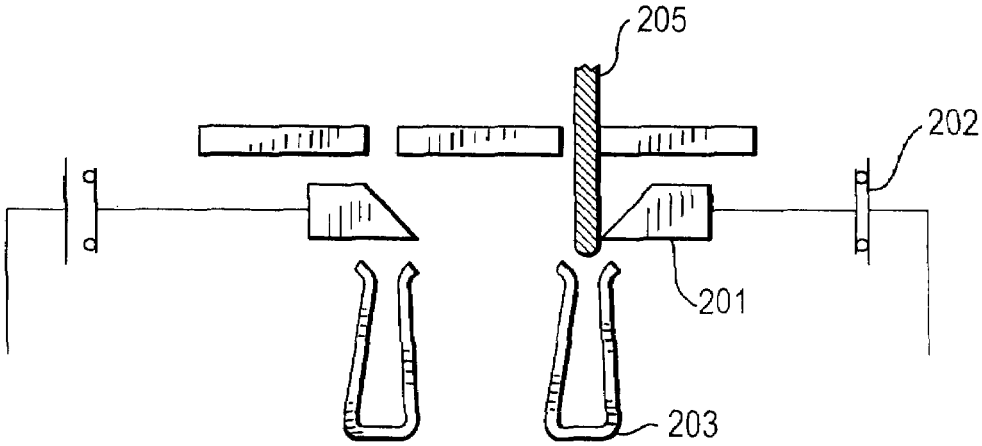
FIG. 3 depicts a detailed top sectional view of a receptacle according to the present invention with one shutter open.

FIG. 3 shows the shutter mechanism in accordance with an embodiment of the invention with one of the shutter switches 202 closed. The 0.050" of travel referred to above (i.e. the movement threshold) serves to prevent tripping one or both of the switches 202 as a result of inserting a plug into the receptacle 100 at a shallow angle. Insertion at greater angles is prevented by the size of the openings 101 themselves. It will be appreciated that in this embodiment, sliding shutters 201 and switches 202 require only a minimal increase in the depth of receptacle 100, in contrast to conventional tamperproof receptacles having cantilever or locking movements which add considerable depth.

Figure 4:
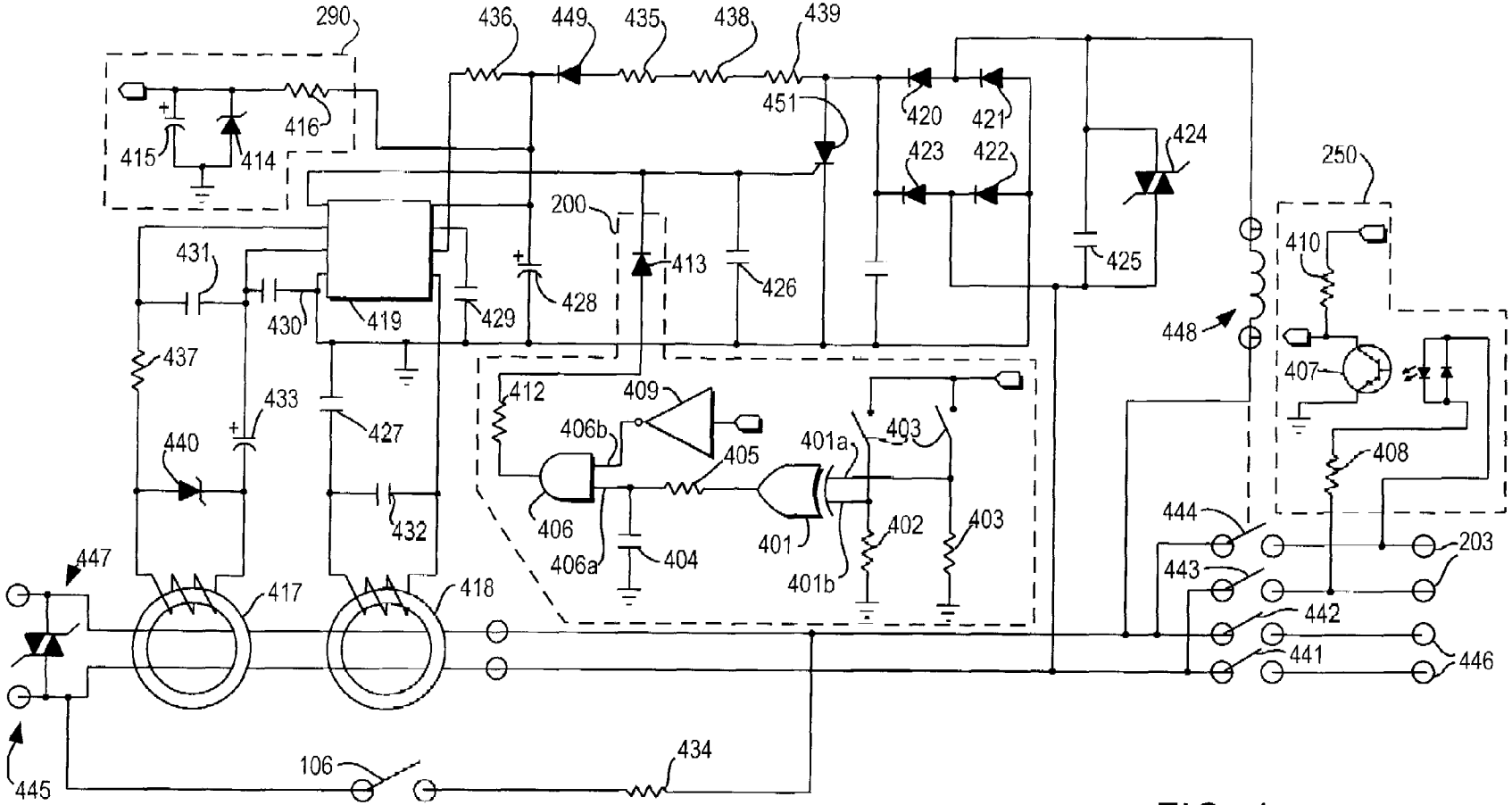
FIG. 4 details a circuit diagram depicting the trip circuitry of the present invention.

FIG. 4 is a schematic diagram of an embodiment of the invention, showing circuitry for rendering receptacle 100 tamperproof In this embodiment, tamper-detection and tamper-proofing circuitry is integrated with a typical GFCI as shown in FIG. 4. It should be noted that the circuit in this embodiment includes the circuit elements contained in logic circuit 200, operating in conjunction with power monitoring circuit 250. The operation and interaction of these circuits is described below. The tamper-detection detection circuit of the present invention is powered from the power supply from the GFCI via circuit 290.

Other elements shown in FIG. 4 comprise a typical GFCI, the structure and operation of which will be described here only briefly. The GFCI comprises a sensing circuit including a differential transformer 417; a Ground/Neutral (G/N) transformer 418; an integrated circuit 419 for detecting current and outputting a voltage once it detects a current; a full wave bridge rectifier comprising diodes 420, 421, 422 and 423; metal-oxide varistors 424 and 447 as surge suppressors; various filtering coupling capacitors and other capacitors 425-433, a gated semiconductor device 451; a relay coil assembly 448; rectifying diode 449; various current limiting resistors 434-439; and a voltage limiting Zener diode 440.

Mechanical switch 106 (coupled to TEST button 103) is shown connected to the conductors of the line terminals. Movable bridge contacts are shown as switches 441-444, connecting line terminals 445 to face terminals 203 and load terminals 446. The line terminals 445, load terminals 446 and face terminals 203 are electrically isolated from each other unless connected by the movable bridge contacts 441-444.

When a predetermined condition occurs (e.g. a ground fault), a difference in current amplitude appears between the two line terminals 445. This current difference is manifested as a net current which is detected by the differential transformer 417. A resulting voltage signal is provided to integrated circuit 419, which then generates a voltage on pin 411, connected to the gate of gated semiconductor device 451. Semiconductor device 451 is typically implemented using a Silicon Controlled Rectifier. The full wave bridge rectifier has a DC side connected to the anode of semiconductor device 451. The voltage signal from pin 411 turns device 451 on, shorting the DC side of the bridge rectifier and thereby energizing relay 448, which engages the movable bridges 441-444 causing them to remove power from the face terminals 203 and load terminals 446. Relay 448 is also energized when mechanical switch 106 is closed, causing a current imbalance on the line terminal conductors that is detected by the differential transformer. The G/N transformer 418 detects a remote ground voltage that may be present on one of the load terminal conductors and provides a current to integrated circuit 419 upon detection of this remote ground which also energizes relay 448.

The tamper-detection and tamper-proofing circuitry in this embodiment of the invention will now be described. In the receptacle 100, each pair of phase and neutral shutter switches 202 is connected to a 5V DC supply on one side and the inputs of an XOR (exclusive OR) gate 401 on the other side. Resistors 402 and 403 independently hold the inputs of the XOR gate 401 to ground unless the shutter switches 202 are closed. In accordance with XOR logic, if both shutter switches 202 are open then the inputs 401*a*, 401*b* to the XOR 401 gate are both 0 and the output of the gate 0. If both shutter switches 201 are closed, the inputs to the XOR gate 401 are both 1 and the output is 0. However, if only one of the shutter switches 202 is closed and the other one is open then the inputs to the XOR 401 are 01 or 10, and the output is 1 or logic high.

When the output of the XOR 401 gate is logic high or 1, capacitor 404 will begin to charge through resistor 405 with time constant T=RC. When a plug is properly inserted into the receptacle, both shutters 201 will be moved aside, so that both shutter switches 202 will close. It is highly unlikely that the two shutter switches 202 will close at exactly the same time; this offset in closure will produce a short pulse at the output of XOR gate 401. The RC network of capacitor 404 and resistor 405 allows the device to ignore these short pulses, because the pulse is not on long enough to charge capacitor 404 up to the logic level 1. However, if an object is pushed into only one opening 101, the output of XOR gate 401 remains high for enough time to charge capacitor 404. This in turn causes input 406*a* of AND gate 406 to be 1 (logic high).

The output of AND gate 406 is high when both inputs 406*a*, 406*b* are high. Input 406*b* is supplied by inverter 409, which is connected to circuit 250 monitoring power at the face terminals 203 of the receptacle. Power monitoring circuit 250 includes an optocoupler 407 and current limiting resistor 408. When power is supplied to face terminals 203, the transistor in the optocoupler 407 conducts, thereby providing a logic low signal to the input to inverter 409. Resistor 410 normally holds the input to the inverter 409 high when the transistor is off (not conducting). A logic high input 406*b* thus indicates that power is present at the face terminals 203. Accordingly, if power is supplied to the face terminals 203, and only a single shutter switch 202 is closed (for a time long compared to T, then the output of AND gate 406 goes high.

When the output of AND gate 406 goes high, current flows into the gate of the Silicon Controlled Rectifier (SCR) 451 through resistor 412 and diode 413. This causes the SCR to conduct, energizing coil 448 and causing the GFCI to trip, thus removing power from the face terminals 203 and load terminals 446 of the device. When power is removed from the face terminals 203 the output of inverter 409 goes low again, so that the output of AND gate 406 goes low again and SCR 451 is turned off. If the user attempts to reset the circuit-interrupting device with a foreign object still present (see FIG. 3), the device will trip instantly as soon as power to the face terminals 203 is detected.

The tamper-detection and tamper-proofing circuitry in this embodiment is powered from the power supply from the GFCI via resistor 416, Zener 414 and capacitor 415. Otherwise, the additional circuitry is independent of the GFCI. Diode 413 prevents the normally low output from the AND gate 406 from interfering with the GFCI signals to the gate of the SCR 451.

Figure 5:
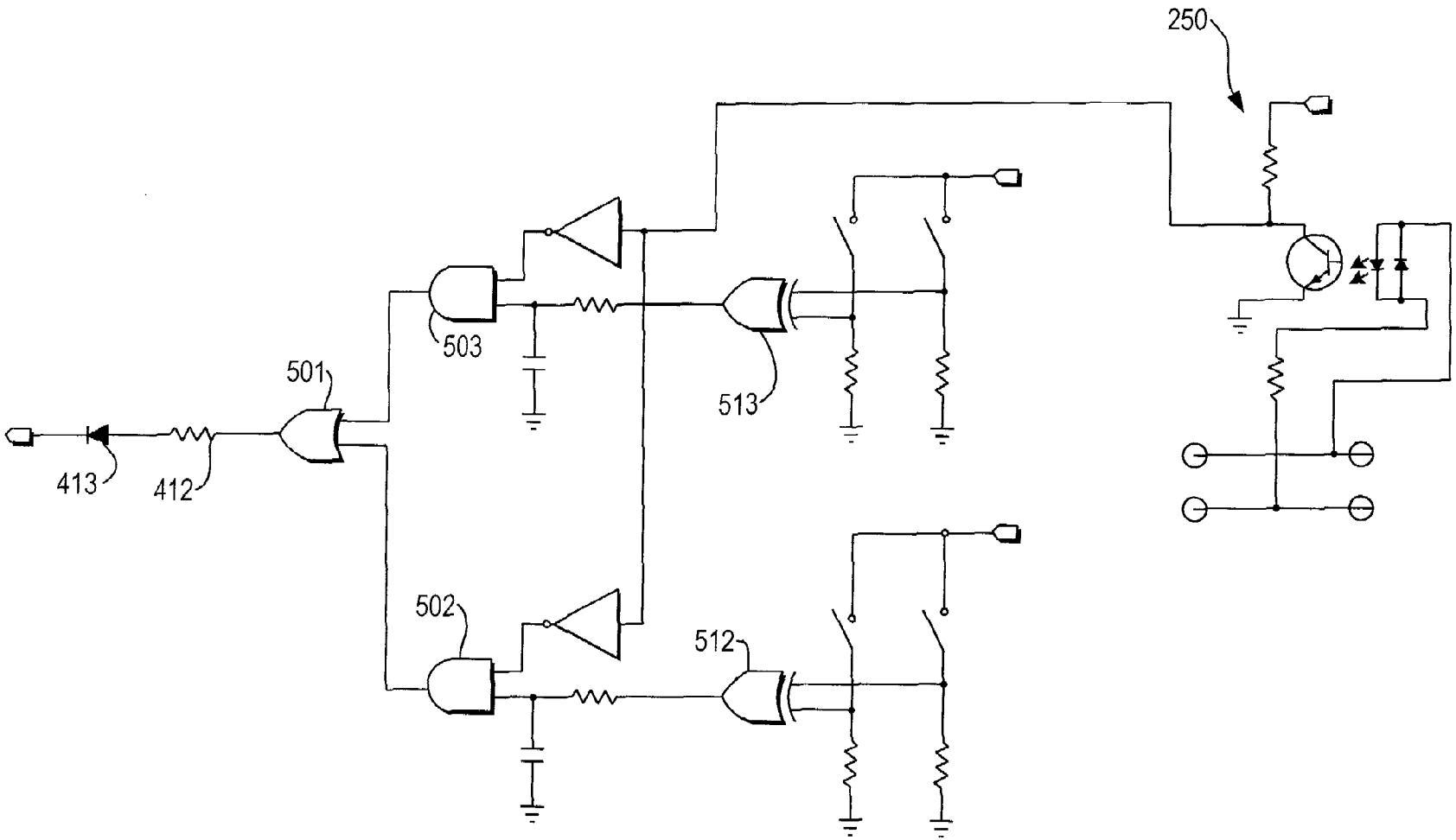
FIG. 5 details a circuit diagram depicting tamperproof circuitry of the present invention for a receptacle with multiple outlets.

FIG. 5 shows how additional pairs of shutters 201 on the phase and neutral receptacle openings 101 may be added to the circuit. In FIG. 5, two AND gates 502, 503, each receiving input from a respective pair of shutter switches via XOR gates 512, 513, are provided in place of the single AND gate 406 of FIG. 4. The output of each AND gate 502, 503 becomes an input to an OR gate 501. The output of OR gate 501 is connected to resistor 412 in series with diode 413 (compare FIG. 4). In accordance with OR logic, if either of the outputs of AND gates 502, 503 goes high, then the output of OR gate 501 goes high and device is caused to trip. More phase and neutral shutter pairs can be added by adding more inputs to the OR gate 501.

The above described implementation of the tamper-proof circuit of the present invention (circuit, sliding shutters and shutter switches) can be applied to any two or three hole receptacle design and is not limited to implementation in a GFCI receptacle.

While there have been shown and described and pointed out the fundamental novel features of the invention as applied to the preferred embodiment, as it presently contemplated for carrying them out, it will be understood that various omissions and substitutions and changes of the form and details of the device illustrated and in its operation may be made by those skilled in the art, without departing from the spirit of the invention.

We claim:

1. A receptacle for providing power to a load, comprising:
terminals for connection to an electrical power source to provide electrical power to said receptacle;
slidable shutters located between openings in said receptacle and said terminals, said shutters operatively connected to a circuit interrupter,
wherein displacement of one shutter, caused by insertion of a member into one of the openings, causes the circuit interrupter to disconnect said terminals from said power source.

2. A receptacle according to claim 1, wherein displacement of said shutter greater than a specific distance causes the circuit interrupter to disconnect said terminals from said power source.

3. A receptacle according to claim 2, wherein the specific distance is characterized as a threshold distance of approximately 0.050".

4. A receptacle according to claim 1, wherein each of said shutters has an angled end surface so that insertion of an object through a corresponding opening causes a cam action between the object and the angled end surface, thereby causing said displacement.

5. A receptacle according to claim 1, further comprising a switch operatively connected to each of said shutters, wherein displacement of a shutter causes the corresponding switch to close, thereby causing the circuit interrupter to disconnect said terminals from said power source.

6. A receptacle according to claim 5, wherein insertion of an object through an opening causes displacement of the corresponding shutter and thereby causes the switch to close, so that the object does not touch any of said terminals while power is connected to said terminals.

7. A receptacle according to claim 1, further comprising a logic circuit, operatively connected to said shutters and said circuit interrupter, for detecting insertion of an object into only one of a pair of openings in said receptacle.

8. A receptacle according to claim 7, further comprising a monitoring circuit for monitoring power supplied to said terminals, said monitoring circuit providing an input to the logic circuit.

9. A receptacle according to claim 7, wherein the logic circuit includes an XOR gate having a pair of inputs coupled respectively to a pair of shutters corresponding to a pair of openings in said receptacle.

10. A receptacle according to claim 9, further comprising a monitoring circuit for monitoring power supplied to said terminals, said monitoring circuit providing a first input to an AND gate of said logic circuit and the output of said XOR gate providing a second input to said AND gate, so that the output of said AND gate indicates insertion of an object into said only one of a pair of openings while power is supplied to said terminals.

11. A receptacle comprising:
a face plate having a pair of openings;
face terminals for connection to an electrical power source;
a pair of shutters, each shutter located between an opening and a corresponding face terminal,
a logic circuit connected to the shutters;
a monitoring circuit, connected to the logic circuit, for monitoring supply of power to the face terminals; and
a circuit interrupting device, connected to the logic circuit, for disconnecting power from the face terminals in accordance with a signal from the logic circuit.

12. A receptacle according to claim 11, further comprising a switch coupled to each of the shutters and providing an input to the logic circuit, wherein displacement of a shutter causes the corresponding switch to close.

13. A receptacle according to claim 12, wherein each of the shutters has an angled end surface so that insertion of an object through the corresponding opening causes a cam action between the object and the angled end surface, thereby causing said displacement.

14. A receptacle according to claim 12, wherein the logic circuit is configured to detect insertion of an object into only one of the pair of openings.

15. A receptacle according to claim 12, wherein the logic circuit includes an XOR gate having a pair of inputs coupled respectively to the switches.

16. A receptacle according to claim 15, wherein the logic circuit further includes an AND gate having a first input connected to the monitoring circuit and a second input connected to the output of the XOR gate, so that the output of the AND gate indicates insertion of an object into only one of the pair of openings while power is supplied to the face terminals.

17. A receptacle according to claim 16, wherein the output of the AND gate provides said signal to the circuit interrupting device, so that insertion of said object into said only one of the pair of openings while power is supplied to the face terminals causes power to be disconnected from the face terminals.

18. A receptacle according to claim 17, wherein said signal to the circuit interrupting device is effective to prevent said object from touching any of the face terminals while power is connected to said face terminals.

19. A receptacle according to claim 16, wherein the face plate has a plurality of pairs of openings and the logic circuit has a plurality of XOR gates, each of said pairs of openings having a pair of shutters with switches and face terminals corresponding thereto, each pair of shutters being coupled to one of the XOR gates by said switches.

20. A receptacle according to claim 19, wherein the logic circuit includes a plurality of AND gates, each of said AND gates having a first input connected to the monitoring circuit and a second input connected to the output of one of the XOR gates, the logic circuit further includes an OR gate having a plurality of inputs each connected to the output of a respective AND gate, and the output of the OR gate provides said signal to the circuit interrupting device.

* * * * *

UNITED STATES PATENT AND TRADEMARK OFFICE

CERTIFICATE OF CORRECTION

PATENT NO. : 7,651,347 B2
APPLICATION NO. : 11/554445
DATED : January 26, 2010
INVENTOR(S) : Germain et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 715 days.

Signed and Sealed this

Twenty-eighth Day of December, 2010

David J. Kappos

David J. Kappos
*Director of the United States Patent and Trademark Office*